US005632043A

United States Patent [19]

Tino

[11] Patent Number: 5,632,043

[45] Date of Patent: May 27, 1997

[54] HAZARDOUS MATERIAL PROTECTION SUIT WITH CARRYING HANDLES

[75] Inventor: Christopher J. Tino, Durham, N.C.

[73] Assignee: Mitsubishi Semiconductor America Inc., Durham, N.C.

[21] Appl. No.: 421,348

[22] Filed: Apr. 13, 1995

[51] Int. Cl.[6] ..... A61G 7/14; A41D 13/00; A62B 17/00

[52] U.S. Cl. ..... 2/457; 2/69.5; 2/2.11; 2/2.14

[58] Field of Search ..... 2/11, 14, 15, 5, 2/2, 901, 69.5, 89, 92, 94, 93, 227; 27/28

[56] References Cited

U.S. PATENT DOCUMENTS

| | | | |
|---|---|---|---|
| 2,414,051 | 1/1947 | Mallory | 2/2.14 |
| 3,164,840 | 1/1965 | Reynolds . | |
| 3,359,567 | 12/1967 | Zemme et al. . | |
| 3,363,266 | 1/1968 | Swet | 2/2.11 |
| 3,533,107 | 10/1970 | Raneri et al. | 2/93 |
| 4,124,908 | 11/1978 | Burns et al. | 2/69.5 X |
| 4,449,253 | 5/1984 | Hettinger | 2/94 X |
| 4,599,750 | 7/1986 | Rahaman | 2/227 X |
| 4,790,040 | 12/1988 | Grilliot et al. | 2/69.5 X |
| 4,816,330 | 3/1989 | Freund et al. . | |
| 5,014,353 | 5/1991 | Brown et al. . | |
| 5,027,807 | 7/1991 | Wise et al. . | |
| 5,081,719 | 1/1992 | Donnelly . | |
| 5,152,013 | 10/1992 | Johnson . | |
| 5,289,896 | 3/1994 | Giglio . | |
| 5,339,806 | 8/1994 | Beaussant et al. | 128/201.21 |
| 5,361,418 | 11/1994 | Luzenske | 2/94 X |
| 5,459,878 | 10/1995 | Gold | 2/227 X |

*Primary Examiner*—C. D. Crowder
*Assistant Examiner*—Shirra L. Jenkins
*Attorney, Agent, or Firm*—Lowe, Price, LeBlanc & Becker

[57] ABSTRACT

A protective garment has a fabric enclosure fitting over and enclosing a human form. Handles are selectively positioned on the garment for enabling the wearer to be lifted and/or carried. Each handle is U-shaped with a flat member affixed to both ends. The flat member is secured against an inner surface of the fabric enclosure and the majority of the U-shaped handle extends on an outer surface of the fabric enclosure.

6 Claims, 1 Drawing Sheet

HAZARDOUS MATERIAL PROTECTION SUIT WITH CARRYING HANDLES

FIELD OF THE INVENTION

The invention relates generally to protective garments. More particularly, the invention relates to a hazardous material protection suit having handles with which to grasp the suit.

BACKGROUND OF THE INVENTION

Each worker and/or other person entering a toxic and/or hazardous chemical spill zone is required to wear a so-called hazardous materials response suit. Generally, such protective suit is made of a laminated material to create a composition that contains the most desirable properties of the individual layers. For example, a material may be a composite of a chemically resistive barrier to prevent the passage of a chemical through the material, and a substrate material that strengthens the chemical resistive barrier so that the composite can be used to make clothing garments.

The industry standard for hazardous materials response suits is either Level "A"—Encapsulated, Gas Tight, or Level "B"—Encapsulated, Not Gas Tight. Both Level A and B suits are, by necessity, oversized and loose fitting. In addition, the person using the suit will almost always be wearing a so-called self contained breathing air apparatus (SCBA) which weighs between 30 and 50 pounds.

As a toxic and/or hazardous chemical spill zone is a dangerous environment, there is a likelihood that a person wearing the suit may become unconscious or incapacitated, requiring manual extraction from the spill zone while still in the suit. When manual extraction of a person encapsulated in the suit is required, two to four "hazardous material team members" manually carry the incapacitated person a distance ranging from 10 to 100 feet. However, manual handling of an unconscious or incapacitated person wearing a Level A or B Hazardous Materials Response Suit is very difficult owing to the size and loose fit of the suit as well as the weight of the SCBA equipment.

As an incapacitated person wearing the suit is extremely difficult to grasp or carry, there is a possibility that a rescuer will have a poor or slipping grip. If this occurs, the incapacitated person may be dragged on an abrasive surface, breaching the hazardous materials response suit and contaminating the wearer.

SUMMARY OF THE INVENTION

It is feature and advantage of the invention to provide a mechanism for easily grasping and/or carrying an incapacitated person wearing an encapsulating protective garment.

According to the present invention, the foregoing and other features and advantages are attained by a protective garment comprising a fabric enclosure fitting over and enclosing a human form. Grasping means are positioned on the garment for enabling the wearer to be lifted and/or carried.

In accordance with one aspect of the invention, the grasping means comprises a plurality of handles.

In accordance with another aspect of the invention a handle is positioned at each of the regions for the shoulders and knees of the wearer of the garment.

In accordance with still another aspect of the invention each handle is U-shaped with a flat member affixed to both ends. The flat member is secured against an inner surface of the fabric enclosure and the majority of the U-shaped handle extends on an outer surface of the fabric enclosure.

Still other features and advantages of the present invention will become readily apparent to those skilled in this art from the following detailed description, where only the preferred embodiment of the invention is shown and described, simply by way of illustration of the best mode contemplated of carrying out the invention. As will be realized, the invention is capable of other and different embodiments in various obvious respects, all without departing from the invention. Accordingly, the drawings and description are to be regarded as illustrative in nature, and not as restrictive.

DETAILED DESCRIPTION OF THE DRAWINGS

Figure 1:
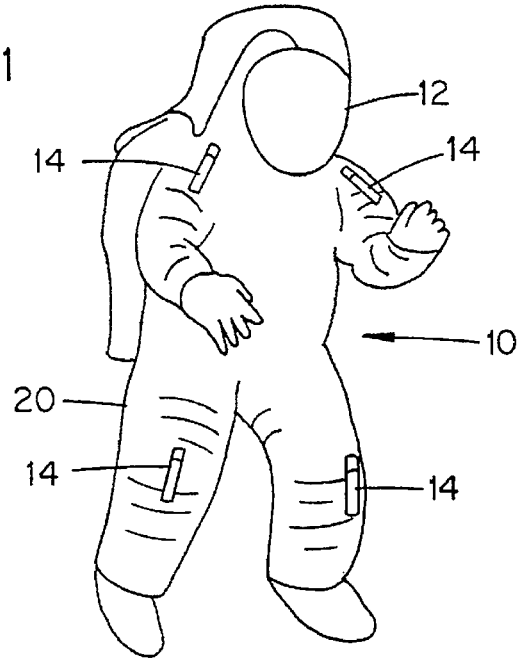
FIG. 1 is a front view of a hazardous material protection suit with handles.

Referring to FIG. 1, a hazardous material protection suit 10 is made of a fabric 20 fitting over and enclosing a human form, and has a face shield 12 in a region in front of the face of the wearer. The suit may be of any desired design, one example of which is the Responder® Level A Vapor Protective Suit by Life-Guard.

Each of the areas proximate the shoulders and the knees of the suit 10 has a handle 14. The shoulder handles are positioned lengthwise between the shoulder and inner bend of the elbow, and the knee handles are positioned lengthwise between the knee and the ankle. The handles permit the wearer of the suit to be easily grasped and/or carried by "Hazardous Material Team Members" in a rescue situation where the wearer of the suit becomes unconscious or incapacitated.

Figure 2:
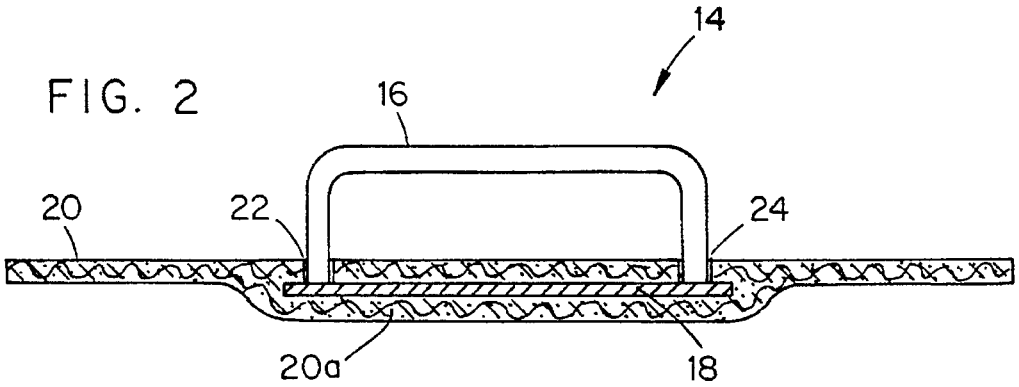
FIG. 2 is a sectional view of one of the handles shown in FIG. 1.

Referring to FIG. 2, each handle 14 has a U-shaped member 16 and a plate 18 attached to both ends of the U-shaped member. The U-shaped member 16 extends on an outer surface of the fabric 20, penetrating the fabric 20 at positions 22 and 24. Each plate 18 is secured to an inner surface of the fabric 20 and prevents the handle 14 from tearing through the suit when rescuers lift and/or carry an incapacitated person using the handles.

Figure 3:
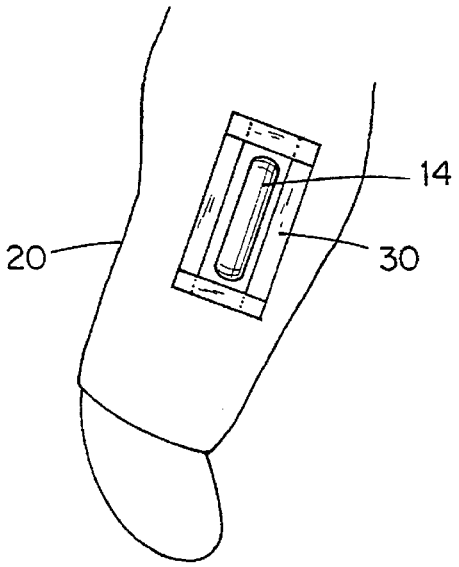
FIG. 3 is a front view on one of the handles of FIG. 1.

Securing each plate 18 to the inner surface of the fabric 20 is accomplished by overlying the plate with additional fabric 20(*a*) and then sewing the additional fabric to the suit. The stitched area is then treated as another seam, i.e. covered inside and out with heat-sealed tape. FIG. 3 illustrates an example of heat-sealed tape 30 covering the outer stitched area of the fabric 20 for the handle on the right leg of FIG. 1.

The handles 14 are made of a rigid material such as stainless steel, ABS plastic, aluminum, etc., and the U-shaped member 16 and plate 18 are sized to carry a 200 pound person wearing SCBA equipment. For example, the U-shaped member can be approximately 1 to 2 inches wide with an overall length of approximately 7 inches. The plate 18 can be approximately 4.5 inches by 9 inches.

There accordingly has been described a protective garment having handles with which to easily grasp and/or carry an incapacitated person wearing the protective garment The many features and advantages of the invention are apparent from the detailed specification, and thus, it is intended by the appended claims to cover all such features and advantages of the invention which fall within the true spirit and scope of the invention. Since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A protective garment comprising:

a fabric enclosure fitting over and enclosing a human form, and grasping means positioned on the garment for enabling manual lifting and/or carrying of the person wearing the protective garment, wherein the grasping means comprises a plurality of handles, a handle is positioned at each of the regions for the shoulders and knees of the wearer of the garment, and each handle is U-shaped with a flat member affixed to both ends, said flat member being secured against an inner surface of the fabric enclosure and the majority of the U-shaped handle extending on an outer surface of the fabric enclosure.

2. The protective garment according to claim 1, wherein the flat member of each handle is secured against an inner surface of the fabric enclosure with additional fabric, and heat-sealed tape covers portions of the fabric enclosure where the additional fabric is secured thereto.

3. The protective garment according to claim 2, wherein the fabric enclosure has a face shield in a region in front of the face of the wearer.

4. A protective garment comprising:

a chemical resistant fabric enclosure fitting over and enclosing a human form, the chemical resistant fabric protecting a person wearing the protective garment against hazardous material exposure; and grasping means positioned on the garment for enabling manual lifting and/or carrying of a person wearing the protective garment, wherein the grasping means comprises a plurality of handles, a handle is positioned at each of the regions for the shoulders and knees of the wearer of the garment and each handle is U-shaped with a flat member affixed to both ends, said flat member being secured against an inner surface of the chemical resistant fabric enclosure and the majority of the U-shaped handle extending on an outer surface of the chemical resistant fabric enclosure.

5. The protective garment according to claim 4, wherein, the flat member of each handle is secured against an inner surface of the chemical resistant fabric enclosure with additional chemical resistant fabric, and heat-sealed tape covers portions of the chemical resistant fabric enclosure where the additional chemical resistant fabric is secured thereto.

6. The protective garment according to claim 5, wherein the chemical resistant fabric enclosure has a face shield in a region in front of the face of the wearer.

* * * * *